US007314007B2

(12) United States Patent
Su

(10) Patent No.: US 7,314,007 B2
(45) Date of Patent: Jan. 1, 2008

(54) APPARATUS AND METHOD FOR ELECTRICAL IMMOBILIZATION WEAPON

(76) Inventor: Li Su, Terapivagen 4H, 9TR, 141 55 Huddinge (SE)

( * ) Notice: Subject to any disclaimer, the term of this patent is extended or adjusted under 35 U.S.C. 154(b) by 135 days.

(21) Appl. No.: 11/061,592

(22) Filed: Feb. 18, 2005

(65) Prior Publication Data

US 2006/0187610 A1 Aug. 24, 2006

(51) Int. Cl.
*H05C 1/00* (2006.01)
*F42B 30/00* (2006.01)

(52) U.S. Cl. ..... 102/502; 42/84; 361/232

(58) Field of Classification Search ..... 42/84; 361/232; 102/502

See application file for complete search history.

(56) References Cited

U.S. PATENT DOCUMENTS 3,803,463 A * 4/1974 Cover ..... 361/232
4,253,132 A * 2/1981 Cover ..... 361/232
5,654,867 A 8/1997 Murray
5,698,815 A * 12/1997 Ragner ..... 102/502
5,786,546 A 7/1998 Simson
5,841,622 A 11/1998 McNulty, Jr.
5,936,183 A 8/1999 McNulty, Sr.
5,962,806 A * 10/1999 Coakley et al. ..... 102/502
5,988,036 A * 11/1999 Mangolds et al. ..... 86/1.1
6,256,916 B1 7/2001 McNulty
6,381,894 B1 * 5/2002 Murphy ..... 42/77
6,575,073 B2 6/2003 McNulty, Jr. et al.

* cited by examiner

*Primary Examiner*—Bret Hayes
(74) *Attorney, Agent, or Firm*—Sughrue Mion Pllc.

(57) ABSTRACT

An electrical immobilization weapon having a prolonged range of effectiveness and improved accuracy compared to conventional Taser weapons, while being compact in structure and lightweight. The weapon having a replaceable cartridge which, when employed, can space a pair of electrodes to a specific critical area on a remote target, so the electrical energy carried by the electrodes can induce the involuntary contraction of the involved muscles through the critical area within a significant range of length between the electrodes for effective immobilization. The electrical energy generated by a power source of the weapon completes an electrical circuit through a minimum path being a length of at least 5 inches between the two points on the target.

25 Claims, 6 Drawing Sheets

APPARATUS AND METHOD FOR ELECTRICAL IMMOBILIZATION WEAPON

BACKGROUND OF THE INVENTION

1. Field of Invention

The present invention generally relates to a type of immobilization weapon which impart high-tension electricity to disable and capture, and more particularly to such a type of weapon which employs at least one cartridge for launching two tailing-wired spreading apart electrical projectiles, to impact a living target and to discharge said high-tension electricity between the two points of the projectiles. The present invention provides improvement over the prior art to significantly increase the effectiveness and accuracy of such weapons.

2. Prior Arts

Weapons for immobilization and capture are generally referred to as "Stun guns". Such devices basically consist of a launch section and a body section, of which the launch section normally contains at least one single cartridge apparatus while the body section mainly accommodates the stun gun electronics and battery compartment. The electronic circuits of the weapon's power supply normally comprise one internal open circuit which, upon its closure, charge the electricity from the battery into the capacitor; and one external open circuit defined by a pair of narrowly spaced electric opposed electrodes on the weapon which, upon firing, is mechanically extended through the conductive wires to a remote target. In practice, the weapon projects two spreading-apart projectiles tethered by the conductive wires with a high voltage difference in between. Immobilization occurs when the space between the projectiles is filled with a living target and the electrical impulses pass from one projectile to the other to complete an electric circuit, dumping electricity into the target's neuromuscular system.

The effectiveness of such weapon depends, among other thing, on its power output and the distance between the projectiles when they are in contact with the target. When said power output is defined, the spreading of the projectiles will largely determine the weapon's efficiency. Within a certain range, the wider the spread between the projectiles, the more extensive the tissue involved for electrical neuromuscular interference, and the more intense the weapon's immobilization ability. However, the increase in spreading for improved effectiveness is not without limit. With the increased spreading, the path for completing the weapon's return circuit also increases, which would involve more tissues of different types of which the linkage of the biological and bioelectrical properties become weaker between tissues. For example, a space between the projectiles greater than 25 inches would not only increase the risk of the projectiles missing the target but also would be likely to reduce its incapacitating efficiency. In order for the electrical impulses to sufficiently disable a human target, the minimum space between two contactor or projectiles is generally considered to be 5-7 inches as described in U.S. Pat. No. 5,841,622. The physiological response at different spreading distances range from merely pain compliance when the spreading is below the said minimum effective distance, to increased intensity of involuntary muscular contraction with the increase of spreading distances, till total override of central nerve system at which a subject lose the ability to voluntarily overcome the contracting force.

Numerous patents disclosing such weapons have been issued which include U.S. Pat. No. 6,256,916 and No. 5,936,183 to Mc Nulty et al; U.S. Pat. No. 5,786,546 to Simson and U.S. Pat. No. 5,654,867 to Murray.

Weapons disclosed in the prior art were desired to have reliable disabling ability; to be as compact and lightweight as possible; to be easily concealable and to have great accuracy covering both close and long range effectiveness. Such a weapon commercialized under the TASER brand is a good example. The TASER weapon possesses superior incapacitating power; weighs only 175 grams and has a body configuration of 6.0×3.2×1.3 inches. Its cartridge weighs only 2 oz and its sizes is 2.13×1.75×1.38 inches. U.S. Pat. No. 6,256,916; No. 5,654,867 and No. 5,786,546 describe similar cartridge structures and configurations. Owing to the restricted space, the electrical projectiles within the cartridge can only be separated a few millimeters apart (6 mm at the exits for a TASER weapon). As a consequence, the projectiles cannot reach an adequate spacing of at least 5 inches after leaving the cartridge for close range effectiveness. The problem is lessened by placement of the two projectiles as such that they intersect at a small angle, so that they can continue to spread apart after being launched and reach the required minimum spread closer to the weapon. However, the improvement for close range effectiveness is compromised by the reduced long range effectiveness since the excessive spreading will lead the projectiles to miss a more remote target. Thus, the compact configuration of the weapon and the angular arrangement of the projectiles in the prior art result in a relatively limited operational shooting range. Below is a list ranking the differences between the distance from a TASER weapon to a target and the spreading space of the two projectiles.

Spread / Distance Chart

| Distance To Target (feet) (1 foot = 30.48 cm) | 2' (61 cm) | 3' (91 cm) | 5' (152 cm) | 7' (213 cm) | 10' (305 cm) | 12' (366 cm) | 15' (457 cm) | 20' (609 cm) |
|---|---|---|---|---|---|---|---|---|
| Spread (inches) (1 inch = 2.54 cm) | 3" (8 cm) | 5" (13 cm) | 8" (20 cm) | 12" (31 cm) | 17" (43 cm) | 20" (51 cm) | 25" (64 cm) | 34" (86 cm) |

As can be noticed, when a target is within a close range of 4 feet to the weapon, the spread of the projectiles would not deliver satisfactory disabling result since the space between the projectiles have not reached the minimum 7 inches, while at a distance longer than 15 feet the projectiles would most likely miss the target because of the excessive spreading of the projectiles relative to a human body or small animal. The optimal shooting range of such a weapon is actually about between 4 feet to 12 feet with maximum accuracy, while closer than 4 feet or longer than 12 feet will likely to cause malfunction. The intersect angle between the projectiles is stated to be 8-12 degrees in such weapons. Further increase of the angle is highly undesirable since it will drastically reduce the long-range effectiveness. The limited effective shooting range of such weapons, both minimum and maximum range, is a serious drawback and could cause dangerous consequences.

It has been found that there exists a range of optimal spreading distance between the projectiles. Within this range, a living target will receive maximum electrical flow and hence achieve maximum effectiveness of a weapon's power supply, which is often characterized by the intensified neuromuscular contraction to such a level at which a subject could not voluntarily overcome the contracting force. While outside this range, both at close and long shooting range, the effectiveness would deteriorate and a subject could gain at least partial mobility while being shocked. For instance, a subject could tear off the insulated copper wires and cause the break down of the weapon's electric circuits as have been observed. To adapt for the changing spreading between the projectiles, the common practices have been to increase the weapons overall power output or prolong its electrical discharge durations or both, which, although would compensate for the deterioration, could result in the electric overload to a subject when the spreading is within the optimal range and render the weapon more dangerous. For a conventional weapon, the said optimal range of spreading often lies in the middle of its effective shooting range, which starts several feet away from the weapon and ends quickly owing to the continued spreading of the projectiles. Therefore, it is deemed desirable to provide a weapon which would reach said minimum effective distance and said range of optimal spreading as close to the weapon as possible and would keep an appropriate spreading distance as far as possible when desired. In such case, instead of defining a weapon's overall power output to adapt for changing spreading distances between the projectiles, the weapon would maintain a constant appropriate projectiles spreading for most of its shooting range, and hence a specific optimized power output can be defined. This would not only reduce a weapon's overall power output to minimize its potential life-threatening hazards while at the same time maintain its maximum effectiveness, but also increase the level of protection for the peace and law enforcement officers who use the weapons.

U.S. Pat. No. 6,575,073 discloses a method and apparatus with the aim to overcome the limited effective range problem. The apparatus in this patent consists of dual vertically spaced-apart cartridges of which each cartridge can launch at least one electrical projectile. Owing to the relative longer spacing and smaller intersect angle between the projectiles, which are 5 to 7 inches and 5 degrees respectively, it can provide an effective shooting range of between 2 and 30 feet. In this case, however, the advantage of relatively improved effective shooting range gives way to a rather bulky body structure. For example, in order to achieve a reasonable result based on the description in this patent, the dual cartridge apparatus would be having a size of approximately 5-7×3-4 inches and a weight of several times that of a standard TASER cartridge. Besides, by using plurality of projectiles and attached wires, the efficiency of the propellant will be reduced, and the increase of total weight of projectiles and wires will also increase the gravitational effect. Furthermore, the plurality of projectiles deliver multiple open circuits on a target, and complete return circuits back to the weapon through more than one gap between the projectiles, which will significantly increase the weapon's power consumption and reduce its battery life circle. Still, the maximum effectiveness of this configuration depends on all projectiles impact on the target, and if all projectiles do impact on a target, the maximum effectiveness would be just as much as if only the projectile on the highest point and the one on the lowest impacted on the target with the longest gap; while if one or both projectiles, which is normally the lowest ones, miss the target, its advantage would be lost. In such case, only the two electric opposed projectiles on the upper side have the effective power while the ones below become useless.

The conventional weapons launch one projectile along the horizontal plane of the cartridge in order to provide guidance to the weapon's laser targeting mechanism, while the other projectile is launched at an angle downward. The latter increases the angular spreading effects and its downward velocity greatly increases its descent due to the gravitational force, which is one of the main causes for limited effective long shooting range. In addition, weapons disclosed in the prior art require that they must be held straight in order for the two projectiles to be arranged in the vertical direction to achieve the desired result, since turning the weapon at all will further increase the risk of causing the projectiles to miss the target. In addition, the projectile on the upper side is normally targeted at the center of the chest of a human body and there is a risk that its hooked sharp head will cause serious injuries to important organs such as eyes, throat, cervical artery and nerve in case of panic or other mistakes. It is desirable to lower this targeting point by a few inches to minimize the risk of said injuries.

OBJECTS OF THE INVENTION

It is therefore the primary object of the present invention to overcome the aforementioned drawbacks and to provide an improved electrical immobilization weapon.

It is another object of the present invention to provide an improvement which can be easily adapted for use by a conventional weapon to increase its effective shooting range.

It is yet another object of the present invention to provide an improvement to maintain an appropriate spreading between the projectiles at long-range operation for increased effectiveness and accuracy.

It is still another object of the present invention to provide improvement of enlarged intersect angle of the projectiles for shortening the weapon's minimum effective range and extending its maximum effective range.

It is still another object of the present invention to provide an improvement of in the distributed angle of flight between the projectiles for reducing the adverse angular gravitational effects.

It is still another object of the present invention to provide such a weapon to be compact, lightweight and easily concealable.

It is still another object of the present invention to provide such a weapon which is more flexible to use.

SUMMARY OF THE INVENTION

The present invention representing the said objects comprises several forms and embodiments. It should be appreciated that although each embodiment described hereinafter may focus on certain features for the purpose of conciseness, the principles of the present invention apply to all embodiments, and the features discussed in one embodiment may also apply to other embodiments. According to one form of the invention, there is provided an electrical immobilization weapon with improvements for increased effectiveness and accuracy. The said improvements include at least one connector, preferably a single connector such as a single filament or a thread interconnected to two electric opposed contactors to act as a kinetic unit. The said kinetic unit carries and maintains an open circuit of the weapon's power supply defined by a single gap between the two contactors and delivers said single gap onto a living target by means of propellant force, and through conductive wires tethering the spreading contactors and connected to the weapon's electric circuit. The completion of a return circuit back to the weapon depends solely on passing high-tension electricity directly through said single gap between the two points or two sites of different electric polarity of the contactors on a living target, which is retained by the length of said connector to have an appropriate distance, for effective immobilization.

The length of said single filament or thread can be predefined to suit different application purposes. Alternatively, the filament could include a length-adjustment means. Preferably, the said length-adjustment means could be part of, or originate from the filament itself to minimize its weight. It can be a means of tie or a buckle, est., for preserving a portion of unused length of the filament and the length can be easily altered if necessary. Said means can be also from the external sources. For a human target, the said filament may have a length of at least equal to or greater than 5 inches between the two contactors, which is sometime considered the minimum distance to achieve effective disabling result; and is preferably within a range of 9-25 inches, which, according to the description in prior art U.S. Pat. No. 5,841,622 and other stun gun manufactures, corresponds to a range of optimal spreading between the two contactors. In such case, the single filament or thread will have a Retained Optimal Projectiles Spreading (ROPS) function in dynamic movement. The filament should be non-conductive to the electric property of the contactors as a whole and preferably is a non-stretchable rigid type by nature, and could be interconnected either directly to the contactors or to their trailing-wires, in either case the desired retaining effect can be achieved. It can be made from materials of any suitable natural or synthetic types, and is preferably of a flexible type in order to be packed easily.

The improved weapon preferably employs electrical projectiles or darts as electrical contactors as that used by such conventional weapons but may be of any other types suited for the application. The projectiles may reside within two separated respective bores, with the bore lines intersect with an angle behind the bores in order to achieve further spreading after being launched, or reside in a single common bore in which the projectiles may accommodate at least one intermediate elastic mechanism or spring device in between for spring apart the projectiles after being launched. The said projectiles could be positioned either vertically as that in a conventional cartridge or horizontally along a horizontal plane of the cartridge, or at another angle. The trailing-wires behind the projectiles could be either separately interconnected to their respective projectile and the electrode of the weapon's power supply, or could be configured to be a single combined main wire containing the two electrically isolated wires, while separated only at their terminals to interconnect the corresponding projectile and electrode of the weapon's power supply respectively. The wire or wires could be coiled into one bobbin or two separate bobbins and stored in at least one bobbin compartment.

The said improvement can be easily adapted for use by existing such weapons with minimum modification. In this case, one projectile could still be positioned along the weapon's horizontal plane while the other positioned vertically below it, and the vertical plane of the projectiles is substantially along the vertical plane of the cartridge. With the affiliation of the single filament, the kinetic effect of acceleration of gravity exerted to the downwardly positioned projectile could be partially lessened by the forward velocity of the horizontally positioned one. However, in order to achieve further improvement, the two projectiles are preferably arranged with one aimed upward, to define a first angle between said projectile and the horizontal plane of the cartridge, while the other angled downward, to define a second angle. The sum of said first and second angle define the intersect angle between the two projectiles. With this arrangement, one projectile can be less downwardly positioned and the adverse angular gravitational effect to the said projectile in kinetic movement will be further offset by the upwardly positioned projectile. Said intersect angle is preferably to be formed at the horizontal medial plane and/or along the vertical medial plane of the cartridge, and the said first angle is equal to the said second angle to yield a symmetric and reversible cartridge configuration. In this case, the intersect angle between the projectiles is at least 5 degrees with a range of 5-12 degrees preferred. The filament could be defined to have a length within the range of the projectile's optimal spreading.

For a TASER weapon with a speed of 150 feet per second, projectiles weigh about 5 grams each and at said intersect angle of 8 degrees, an optimal spread, for example a spread of 16 inches, would be reached at a distance of about 9.5 feet and would continue to spread apart if without any control. In this case however, the filament will retain the spreading to have a length of the defined 16 inches, and the two projectiles, instead of continuing traveling along their angular orientation, will change direction and travel forward by keeping this optimal distance until hitting a remote target. Thus, the weapon's initial maximum effective long shooting range of 20 feet with a spreading of 34 inches at that distance is extended beyond with optimized incapacitating power, and its accuracy is improved at remote distance.

According to another aspect of the present invention, further improvement can be achieved with an Enhanced Projectiles Angular Extension (EPAE) method cooperatively in accordance with the present invention by placement of the two projectiles with larger intersect angle. The said angle is at least 12 degrees, which is considered the maximum acceptable angle for a conventional weapon of such type. In one preferred embodiment, the projectiles intersect at a substantial angle of 15-50 degrees which is several time greater than that of a TASER weapon. Contrary to the prior art with regard to improvement of the effective shooting range, the present invention allows reducing the minimum distance between the two electric opposed projectiles to proximity instead of increasing it, and making the cartridge and the weapon even more compact and lightweight. In one embodiment, the increase in angle is accomplished by arrangement of their respective bores with minimum distance of proximity in between at their rear, and with a maximum distance in between at their exits, and the bore lines intersect with an angle which is in proximity behind them.

With such arrangement, improvement for both close range and long range effectiveness will be achieved. For example, for bore lines that are just 6 mm apart at exit along the cartridge's vertical line, which is the same as a TASER weapon, and the angle of the bore lines is as much as 30 degrees, the projectiles can travel along a horizontal flight path for as long as the gravitational effects and the weapon's accommodation of safe force factors permit. Yet the projectiles would have an effective spread of 7 inches when they had flown only 1 foot horizontally from the weapon. This configuration of the improved weapon thus has an effective range between 1 foot and at least 30 feet and beyond. This is compared with an effective range of between 4 and 20 feet by a conventional TASER weapon, and with that of between 2 and 30 feet as described in U.S. Pat. No 6,575,073. It is important to notice, however, that the benefit of the present invention would allow the projectiles reach a range of aforementioned optimal spreading much closer to the weapon and would keep this spreading throughout afterwards. For instance, the projectiles would reach a spreading of 14 inches when they had flown only 2 feet and continue to fly with this spreading. While the same spreading would be achieved at 8.3 feet by a TASER weapon and at 6.6 feet by a weapon described in aforementioned patent, yet the projectiles would continue to spread apart and would have a spreading of 34 inches at 20 feet for the former and 36 inches at 30 feet for the latter.

Unlike the conventional weapon which can only be held vertically straight, the present invention will allow the weapon to be turned substantially level to the ground. The stunning result will be equally effective even if just one projectile hit a target in the front. In this case, a force movement is created between the target and the other projectile, and instead of moving forward the projectile is forced to move inward around the body of the target and hit the target on the side or the back, thus reacts a "hugging effect" of the weapon. To minimize the vibration of the projectiles when they are being restrained by the filament and to achieve maximum result of said "hugging effect", in preferred embodiments the filament or thread can be connected to locations on the projectiles which are at or close to their center of gravity and preferably a bit forward. Each projectile can have at least one spiky or hooked head section and an elongated body section, and the head section could have multiple contacting heads with same electric polarity of the weapon's power supply to increase its efficiency. One benefit of such horizontal deployment is that the targeting point can be lowered by few inches without fearing reduction of weapon's accuracy, especially when a target is at a great distance. It would also reduces the potential risk of ventricular fibrillation and asphyxia, which, according to several articles, could happen even after the stun current is ceased, by avoiding the chest organs as much as possible. The horizontal firing of both projectiles also suffers less from angular gravitational effect compared to vertical firing of which at least one projectile would be launched downwardly. Alternatively, the projectiles can be designed to have a fixed horizontal configuration in the cartridge. In such case, instead of having substantially the same vertical plane between the projectiles and the cartridge as for a conventional weapon, the projectiles will have a horizontal plane which is substantially perpendicular to the vertical plane of the cartridge. Preferably, one projectile is positioned horizontally at one side of the vertical plane of the cartridge to form a first angle between said projectile and the vertical plane of the cartridge and the other projectile positioned horizontally at the other side to form a second angle. The sum of said first and second angle define the intersect angle between the two projectiles and the said two angles are preferably equal to each other. Said intersect angle in this case is preferably formed at the vertical medial plane and/or along the horizontal medial plane of the cartridge.

BRIEF DESCRIPTION OF THE DRAWINGS

The aforementioned objects and advantages of the present invention, as well as additional objects and advantages thereof, will be more fully understood hereinafter as a result of a detailed description of preferred embodiments by way of examples and without the intention of limiting their definitions when taken in conjunction with the following drawings in which.

DETAILED DESCRIPTION OF PREFERRED EMBODIMENTS

Figure 1:
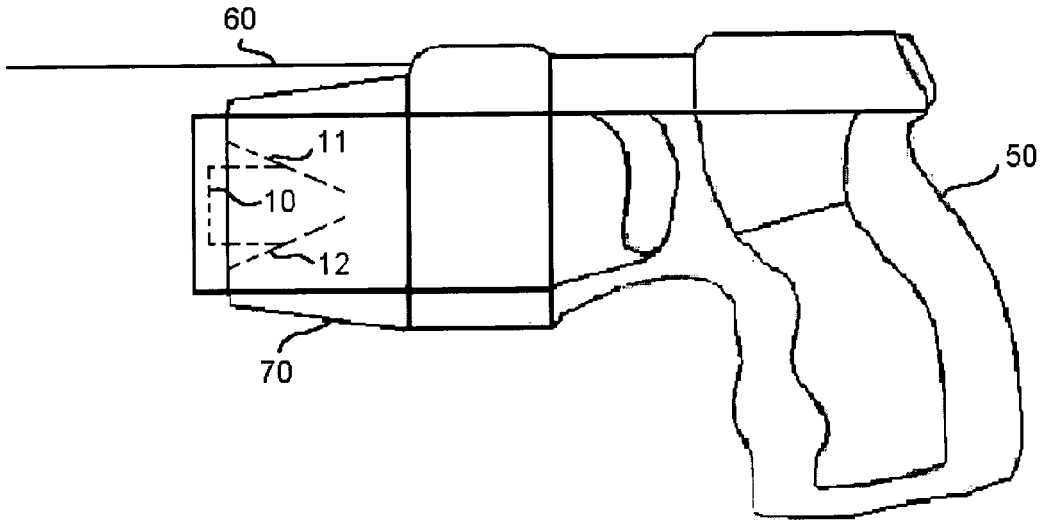
FIG. 1 is an outlined plan view of a weapon according to a preferred embodiment of the present invention.

Referring now to FIG. 1, there is provided an outlined illustration of an electrical immobilization weapon in conjunction with a preferred embodiment of the present invention, which mainly comprises a body section (50) and at least one cartridge apparatus (70). In this case the cartridge is inserted. The weapon utilizes a type of high-tension power supply (not shown) which could be any suitable power supply already known to the art. The single cartridge in this case contains two projectiles (11, 12) along a vertical plane of the cartridge (70) as shown with dotted lines. A single filament or thread (10) is interconnected to the two projectiles (11, 12) to form a kinetic unit, which can be launched by a common propellant. The said propellant could be any suitable types commercially available, for examples spring devices, compressed air, compressed CO2, explosive or pyrotechnic. The weapon can be designed to be single or multiple fired. Because of its compact size, other accessories such as a laser-pointer (60), illumination light source or video data device can be conveniently added to the weapon. The shape of the weapon herein resembles a conventional handgun, but in other embodiments it could have different shapes.

Figure 2:
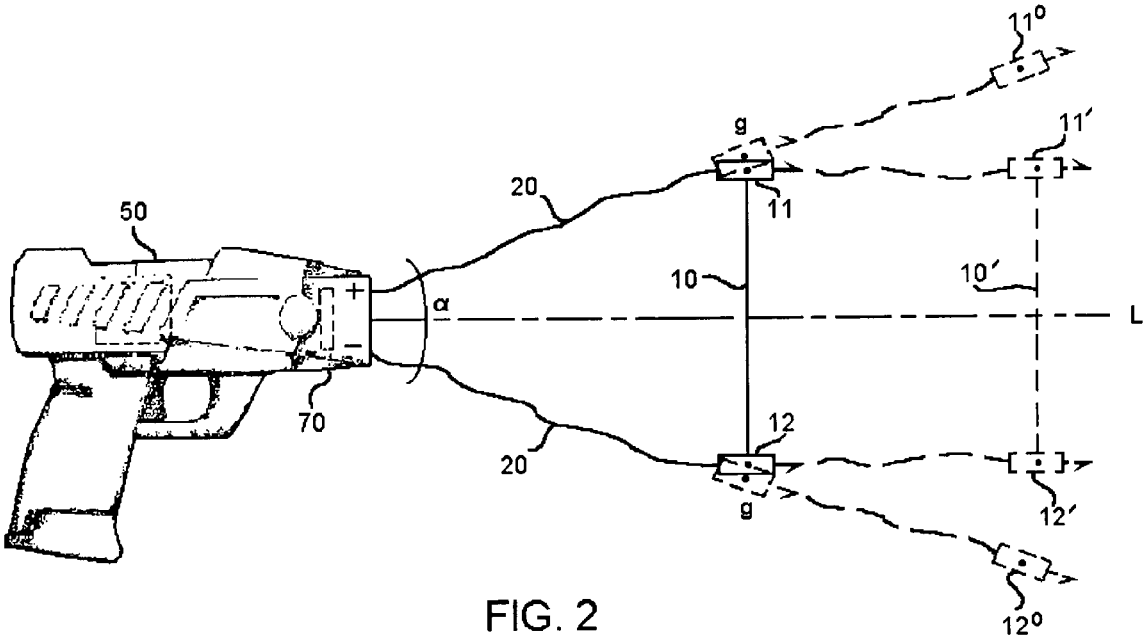
FIG. 2 is a representing view of the weapon's dynamic feature in conjunction with the present invention.

Referring now to FIG. 2. Two electric opposed projectiles (11, 12) are being launched from a single cartridge (70) with a certain angular orientation. The single filament (10) is interconnected between the projectiles (11, 12) at or close to their center of gravity as shown by the small dots. The point "g" indicates the moment when the single filament (10) is fully stretched to an appropriate length. Projectiles ($\mathbf{11}^{o}$, $\mathbf{12}^{o}$) in dotted lines show the directions they would travel without the filament (10), while projectiles (11', 12') indicate the actual directions of the projectiles (11, 12) with the filament (10). Since the filament or thread (10) and the projectiles (11, 12) act as a single kinetic unit, and since the kinetic energy required to stretch the filament (10) is provided internally by said kinetic unit, the projectiles (11, 12) will then substantially keep the maximum allowed stretching angle and travel forward, thus keeping a substantially constant distance between the two projectiles (11, 12). In one preferred embodiment, the two projectiles (11, 12) are launched along the vertical medial plane of the cartridge (70) with one (11) upward and the other downward (12) relative to the horizontal plane of the cartridge (70), and the angle of flight "α" is equally distributed between the two projectiles (11, 12). Owing to the presence of the filament (10), the effect of acceleration of gravity exerted to the downward projectile (12) is significantly offset by the upward projectile (11); The continued forward flight of projectile (11) or (12) will also provide reliable guidance for the weapon's targeting point. By turning the weapon substantially 90 degrees, the two projectiles (11, 12) will then be both launched in a horizontal plane relative to the ground.

Figure 3:
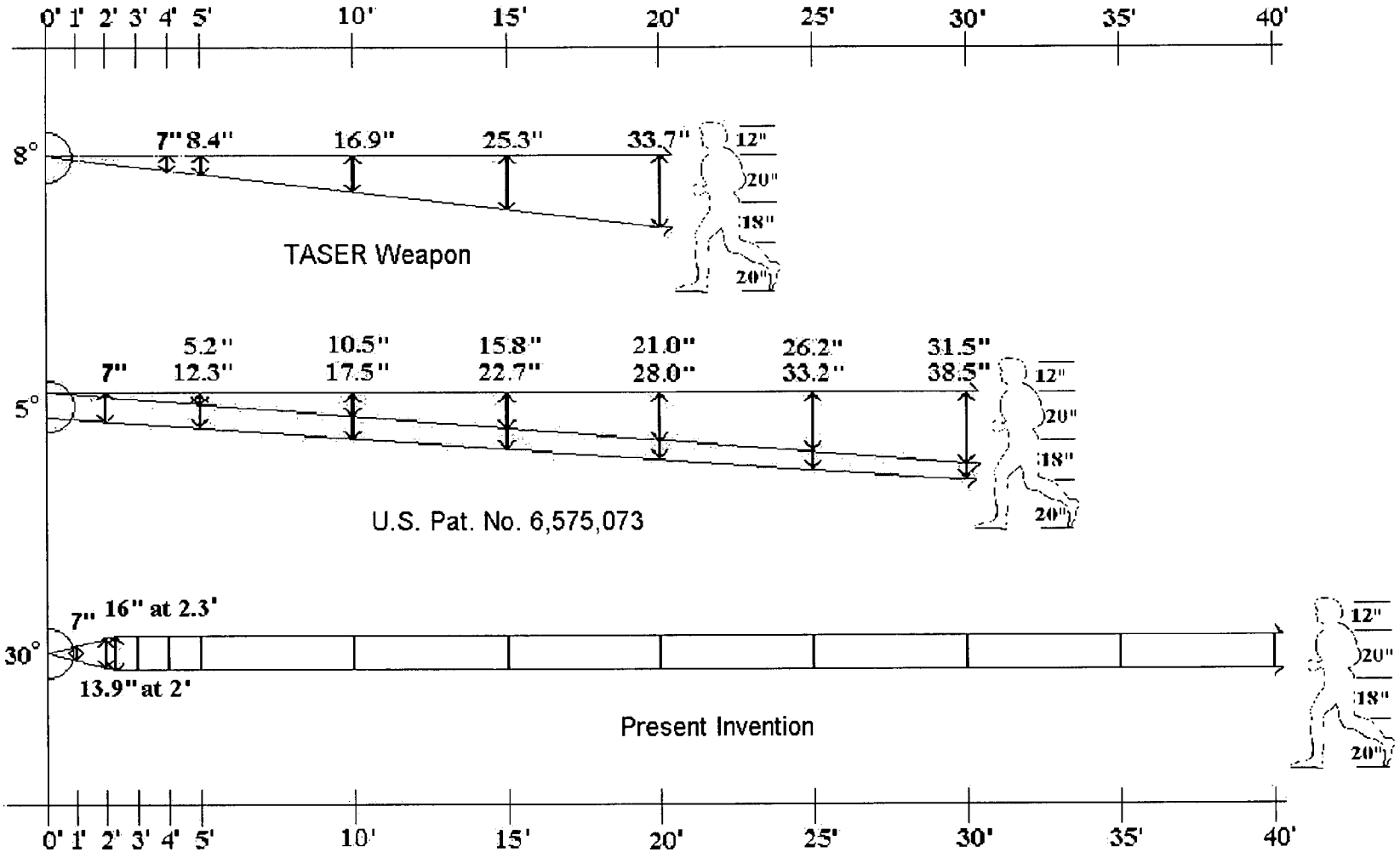
FIG. 3 is a graphic indication and comparison of the effective shooting ranges and the relative spreading of the projectiles at different distances.

Referring now to FIG. 3. The graph shows that for a conventional TASER weapon, the effective range has a maximum of 20 feet and a minimum of about 4 feet; compared with that of a maximum of 30 feet and a minimum of 2 feet for a device shown in prior art U.S. Pat. No. 6,575,073; while the maximum is at least 30 feet and beyond and the minimum is 1 foot for the improved embodiment herein. In this case, the improvement allows the projectiles to reach a range of optimal spreading much closer to the weapon, that is a 13.9 inches at distance of 2 feet and 16 inches at distance of just 2.3 feet. At maximum range, the spreadings between the two projectiles are 33.7 inches and 38.5 inches respectively for the TASER weapon and the said prior art, which become unfavorable relative to the likelihood of hitting a remote target; while the inventive embodiment herein will keep a predefined 16 inches optimal spreading throughout. The scales in the graph are roughly proportional.

Referring now to FIGS. 4-9. The basic structures of a cartridge are shown. Briefly, a pair of projectiles (11, 12) resides in their respective bores (21, 22). The bore lines intersect at a small angle behind the bores (21, 22), with a minimum distance between said bores at their rear and a maximum distance at their exits. The projectiles (11, 12) are to be propelled by at least one common propellant (30) upon its puncture by a nearby detonating device (40) to release the propellant force. The detonating device (40) comprises a case, a slidable punching bullet that can be shot by ignition of a pyrotechnic primer. Of course, other suitable propelling devices could be used as well. The pyrotechnic primer (42) and the case (44) of the detonating device (40) are connected to the respective terminals (32) in the cartridge which in turn are connected to the electrodes of the weapon's power supply respectively when the cartridge is inserted. Thus, any high voltage applied to the terminals (32) will discharge through the pyrotechnic primer (42), causing explosion of the primer which in turn will propel the punching bullet against the wall of the propellant (30). The projectiles (11, 12) are tethered by conductive wires (20), which are also connected to the terminals (32) respectively.

Figure 10A:
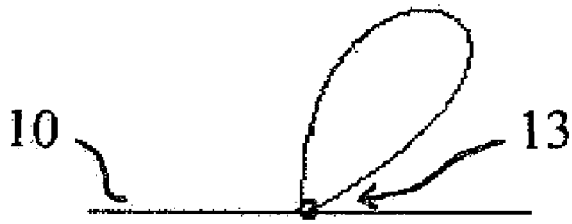
FIGS. 10A and 10B show non-limiting embodiments of a length-adjustment feature of the filament or thread.
Figure 10B:
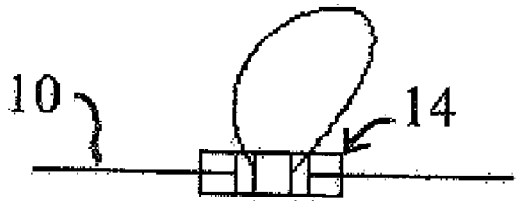

The preferred single filament or thread (10) is interconnected halfway to the projectiles (11, 12) at or near their center of gravity as indicated by the small circle. Said filament (1) can be integrately coupled to the projectiles (11, 12) inside the cartridge (70) by any suitable known methods, for example by loose embedffient into a notch made on the projectiles. At least a portion of the filament (10) could be pulled out from the bores (21, 22) and packed either directly in the gap between the cartridge's substantial front facade and its front shutter cover (26), or in a separate concave compartment (24) made on the said substantial front facade in front of the cartridge. As shown in FIGS. 10A and 10B, and discussed previously, the length-adjustment means of the filament or thread (10) can be, for example, a tie (13) or a buckle (14) that can alter the length of the filament or thread (10) to a desired length launching of the projectiles (11, 12). The length-adjustment feature is, however, not limited to the examples as shown. For example, the repeated bends or coils of the filament or thread (10), as shown inside the concave compartment (24) of FIG. 4, can provide a tyne of length adjustment.

Figure 4:
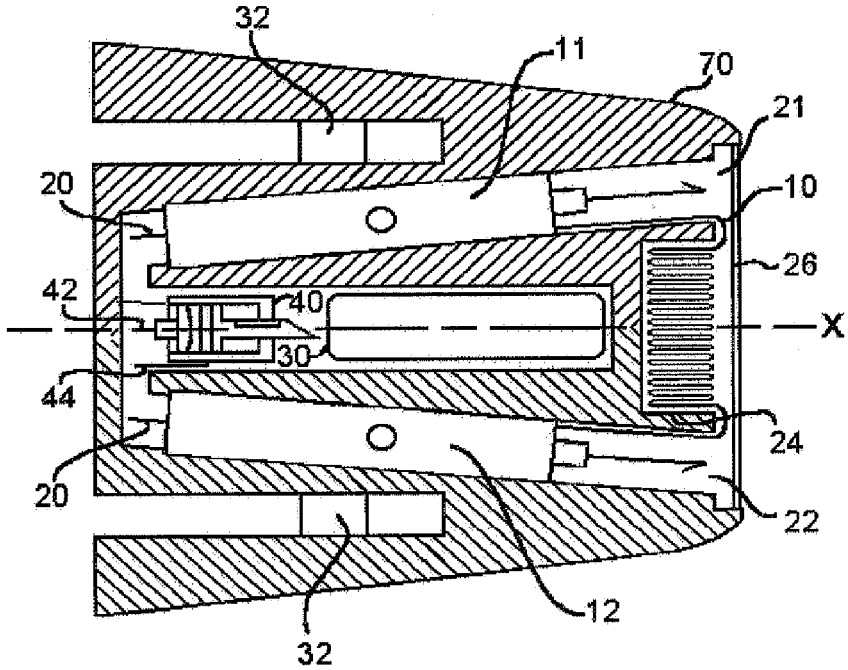
FIG. 4-FIG. 9 are schematic sectional views of several arrangements showing the static features of preferred embodiments.

In FIG. 4, the bore lines intersect at a small angle of 5 to 12 degrees behind the bores (21, 22). The projectile (11) in this case is positioned vertically upward relative to the horizontal plane of the cartridge instead of along the said plane. The propellant (30) and/or detonating device (40) are normally arranged between the projectiles (11, 12).

Figure 5:
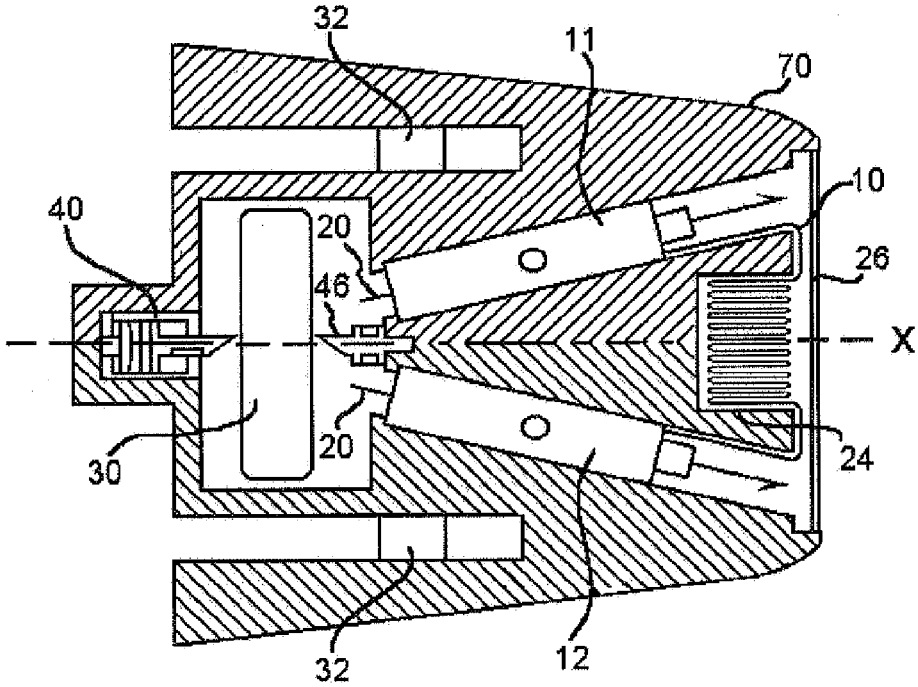

In FIG. 5, an arrangement with increased intersect angle between the projectiles (11, 12) is shown. In this case, the minimum distance between the two projectiles (11, 12) is reduced to proximity, and the their imaginary point of intersection is also in proximity behind them. In this case, the said angle is at least equal to or larger than 12 degrees, and is preferred to be 15-50 degrees. The propellant (30) and/or the detonating device (40) could be located in the back of the projectiles (11, 12) instead of between them. The cartridge (70) may include an additional passive puncture member (46) to increase the efficiency of releasing the propellant power. The longitudinal axis of the propellant (30) is substantially perpendicular to that of the detonating device (40); and said longitudinal axis of the propellant (30) could be either substantially along the vertical plane as shown in the figure or substantially perpendicular to the vertical plane of the cartridge (70). Other suitable orientations and arrangements of course are usable.

Figure 6:
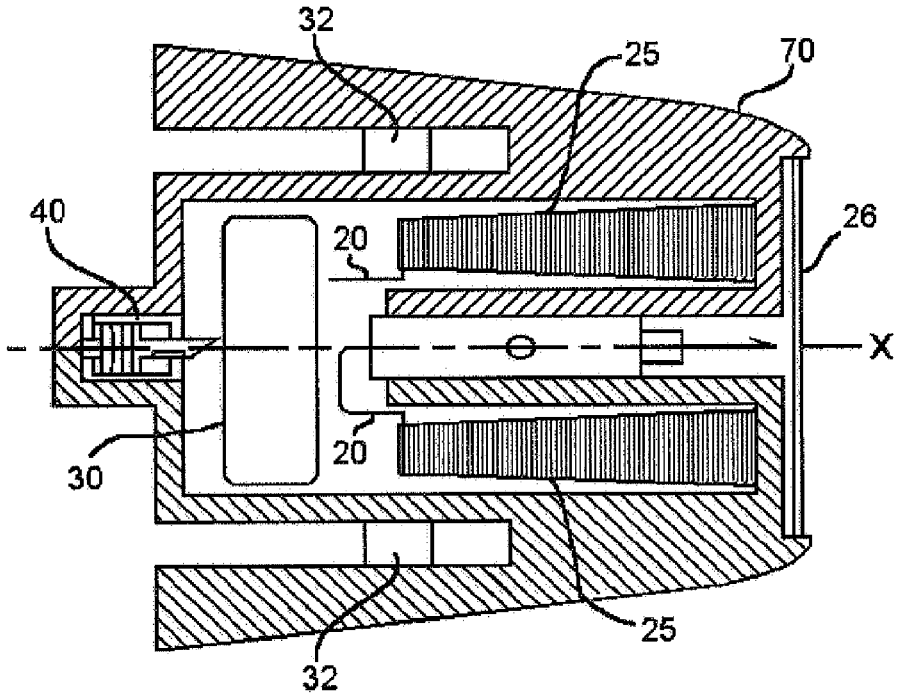
Figure 7:
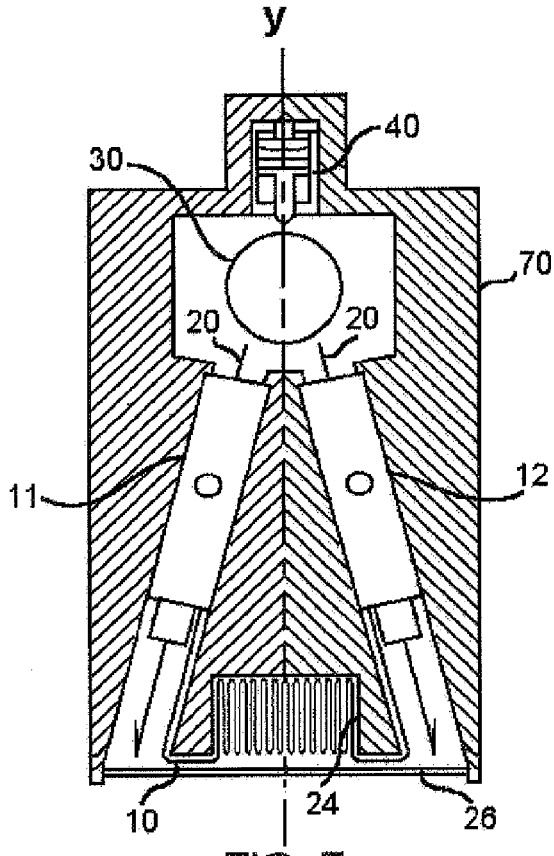

In FIG. 6, there is shown an arrangement in which the projectiles (11, 12) are being positioned horizontally compared to the vertically configured cartridge. In this case, the projectiles (11, 12) will have a horizontal main body plane which is substantially perpendicular to the vertical plane of the cartridge (70). The conductive wires (20) are coiled in two bobbins (25) and the bobbins could be located with one above and the other below the projectiles (11, 12) instead of flanking them. FIG. 7 is a sectional top view of the arrangement as shown in FIG. 6.

Figure 8:
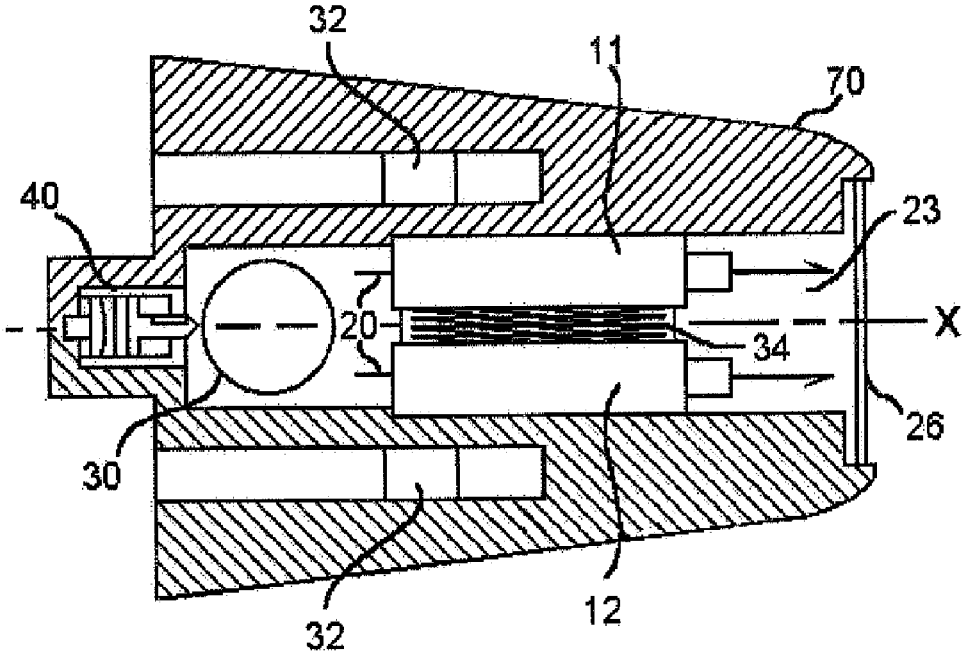
Figure 9:
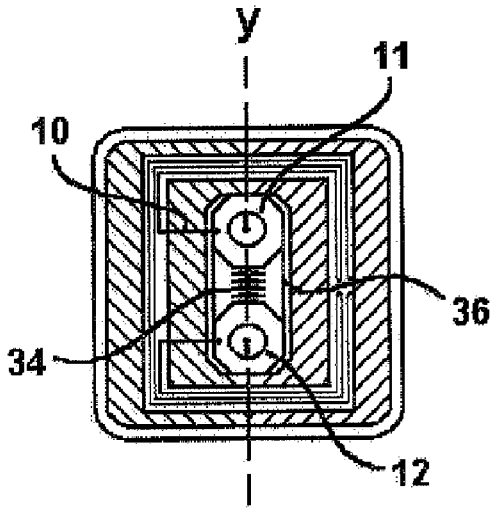

In FIGS. 8-9, an arrangement of the two projectiles (11, 12) residing in a common bore (23) is shown. In this case, the projectiles (11, 12) are positioned substantially parallel to each other. The two projectiles (11, 12) could be separated by non-conductive material if necessary and accommodate at least one elastic mechanism (34) such as spring device in between, which may be embraced or encircled by at least one outer shell (36) when said elastic mechanism (34) is in the compressed status to restrain its elastic force and to minimize the friction to the bore (23). In the figure, a pair of flanking outer shells (36) is used. The main body of the projectile in the figure has a hexangular cross-sectional shape but could have other suitable shapes such as round. The filament (10) could be packed either with the same principle as shown in the figure and other embodiments, or at least a portion of said filament could be packed in the elongated gap formed by said projectiles (11, 12), said elastic mechanism (34) and said outer shell (36). FIG. 9 is a front view of the arrangement as shown in FIG. 8 taken immediately behind the shutter cover (26).

The invention claimed is:

1. A replaceable cartridge for use with a weapon having a power source remotely located from a target for generating selected high voltage electrical energy, the replaceable cartridge comprising:

a cartridge housing defining one single pair of wire-tethered electrodes, and operatively contacting said electrical energy for applying said electrical energy though said wire tethers to said remote target;

at least one non-conductive connector for interconnecting said electrodes, said connector being a length of at least 5 inches;

a propellant to be selectively activated and operative to propel said electrodes divergently to said remote target together with said connector;

wherein said single pair of electrodes, said wire tethers and said connector constitute one single open circuit unit in the cartridge for transmitting said electrical energy within a selected potion on said remote target.

2. A cartridge according to claim 1, wherein said connector includes a filament or a thread interconnecting the electrodes or said wire tethers.

3. A cartridge according to claim 2, wherein at least a portion of said filament or thread is packed in a gap or concave compartment provided behind a front shutter cover of the cartridge.

4. A cartridge according to claim 3, wherein said filament or thread includes a length-adjustment means.

5. A cartridge according to claim 4, wherein said length-adjustment means is of the filament or the thread itself or is from an external source being packed in said gap or said concave compartment for preserving a portion of unused length as well as energy for stretching said filament or thread and operative to adjust said filament or thread to a predefined length.

6. A cartridge according to claim 2, wherein said electrodes include a pair of projectiles each including at least one spiky or hooked head portion and an elongated body portion.

7. A cartridge according to claim 6, wherein said single filament or thread is interconnected to said projectiles in positions at or near their centers of gravity.

8. A cartridge according to claim 6, wherein the housing includes two separate respective bores with center bore lines that intersect with an angle of at least between 5 and 50 degrees at a point behind the bores and each bore for accommodating one projectile, or a single common bore for accommodating both projectiles in the bore having at least an elastic or spring mechanism there between.

9. A cartridge according to claim 8, wherein the single filament or thread is integrated substantially halfway to the body of each of the projectiles and at least a portion of the connecting filament or thread resides within the respective bore together with each of the projectiles.

10. A cartridge according to claim 9, wherein the projectiles are arranged substantially symmetric to axes of the cartridge.

11. A cartridge according to claim 8, wherein when said common bore is provided, said projectiles are positioned substantially parallel to each other within said common bore.

12. A cartridge according to claim 11, wherein said projectiles are separated with a nonconductive material in between.

13. A cartridge according to claim 12, wherein said projectiles are embraced or encircled by at least one outer shell when said elastic mechanism in between is in a compressed state.

14. A cartridge according to claim 13, Wherein said outer shell including a pair of flanking shells.

15. A cartridge according to claim 14, wherein at least a portion of said filament or thread is placed in the gap between the projectiles.

16. A cartridge according to claim 8, wherein at least a common propellant is secured to the bore for propelling the projectiles to said remote target.

17. A cartridge according to claim 16, wherein the propellant including compressed gas preserved in a container or a separate pyrotechnic primer.

18. A cartridge according to claim 1, wherein coupling of said electrodes to the electrical energy includes a pair of exposed contact terminals on the cartridge connected to the electrodes inside the cartridge with conductive wires respectively.

19. A cartridge according to claim 1, wherein said single open circuit unit is propelled to said remote target substantially along a same plane.

20. A method of using a power supply and a single pair of electrodes in a cartridge for spacing said electrodes to a selected portion on a remote target, said method comprising:

launching said pair of electrodes, carrying respective conductive wires, from the cartridge to the remote target, said conductive wires being respectively connected to each of said electrodes and said power supply, engaging one of the electrodes with one location on the remote target, and engaging the other electrode to another location on the remote target, where the pair of electrodes are interconnected through a non-conductive connector, wherein the connector is at least 5 inches in length such that the electrodes, the respective conductive wires and the connector constitute one single open circuit delivering unit to the selected portion on the remote target.

21. A method according to claim 20, wherein the step of launching the electrodes includes directing the electrical energy of said power supply to detonate a pyrotechnic primer in the cartridge, the pyrotechnic primer thereafter directly producing energy to propel the electrodes or to create at least one opening on a container preserving compressed gas to propel the electrodes.

22. A method according to claim 20, wherein the step of launching the electrodes includes launching the electrodes from two separate respective bores of said cartridge, wherein the two separate respective bores having an angle therebetween of at least between 5 and 50 degrees.

23. A method according to claim 20, wherein the step of launching the electrodes includes launching the electrodes from a single common bore and a separation of the electrodes outside the cartridge is provided via an elastic or spring device in between the electrodes in said cartridge so as to spring the electrodes.

24. A method according to claim 20, wherein said single open circuit delivering unit is launched to the remote target substantially along a same plane.

25. A replaceable cartridge for use with a weapon having a power source remotely located from a target for generating selected high voltage electrical energy, the replaceable cartridge comprising:

a cartridge housing defining one single pair of wire-tethered projectiles and operatively contacting the electrical energy for applying the electrical energy through the wire tethers to the remote target;

a single, flexible non-conductive filament interconnecting the projectiles, the filament having a length of at least 5 inches;

a propellant to be selectively activated and operative to propel the projectiles divergently to the remote target together with the filament;

wherein the single pair of projectiles, the wire tethers and the single filament constitute one single open circuit unit in the cartridge for transmitting the electrical energy within a selected portion on the remote target.

* * * * *